US009651271B2

(12) United States Patent
Saffre et al.

(10) Patent No.: US 9,651,271 B2
(45) Date of Patent: May 16, 2017

(54) METHOD AND SYSTEM FOR CONTROLLING CONSUMPTION

(71) Applicants: Khalifa University of Science, Technology, and Research, Abu Dhabi (AE); British Telecommunications plc, London (GB); Emirates Telecommunications Corporation, Abu Dhabi (AE)

(72) Inventors: Fabrice Saffre, Ipswich (GB); Mark Shackleton, Ipswich (GB); Hanno Hildmann, Abu Dhabi (AE); Sébastien Matthieu René Nicolas, Abu Dhabi (AE)

(73) Assignees: Khalifa University of Science, Technology and Research, Abu Dhabi (AE); British Telecommunications plc, London (GB); Emirates Telecommunications Corporation, Abu Dhabi (AE)

( * ) Notice: Subject to any disclaimer, the term of this patent is extended or adjusted under 35 U.S.C. 154(b) by 604 days.

(21) Appl. No.: 14/104,425

(22) Filed: Dec. 12, 2013

(65) Prior Publication Data

US 2015/0167998 A1 Jun. 18, 2015

(51) Int. Cl.
*F24F 11/00* (2006.01)

(52) U.S. Cl.
CPC ... *F24F 11/0009* (2013.01); *F24F 2011/0075* (2013.01)

(58) Field of Classification Search
CPC ..... F24F 11/0009; F24F 2011/0075; F24F 11/001; F24F 11/006; F24F 2011/0047;
(Continued)

(56) References Cited

U.S. PATENT DOCUMENTS 4,897,798 A 1/1990 Cler
2005/0222715 A1 10/2005 Ruhnke
(Continued)

FOREIGN PATENT DOCUMENTS

EP 0852331 7/1998
GB 2448896 11/2008
WO 2009/122173 10/2009

OTHER PUBLICATIONS

"Occupancy Based Deman Response HVAC Control Strategy" by Erickson et al., BuildSys, Nov. 2, 2010.
(Continued)

*Primary Examiner* — Robert Fennema
*Assistant Examiner* — Shon Foley
(74) *Attorney, Agent, or Firm* — Calfee Halter & Griswold, LLP

(57) ABSTRACT

This invention relates to methods and systems for controlling consumption, particularly power consumption, more particularly by appliances in a building, and is generally suitable for integration with building management systems. Embodiments of the invention provide methods and systems which probabilistically limit the aggregated power load of a plurality of climate control appliances in a building to a selected value, while seeking to minimize the deviation from target environmental conditions within the building. The embodiments of the invention propose distributed decision-making by individual devices based on projected deviation from the target conditions after a period of activity or inactivity.

17 Claims, 5 Drawing Sheets

(58) Field of Classification Search
CPC ..... F24F 2011/0064; F24F 11/0034; G05D 23/1923; H02J 3/14
USPC ..... 700/276
See application file for complete search history.

(56) References Cited

U.S. PATENT DOCUMENTS

| | | | | |
|---|---|---|---|---|
| 2010/0163633 | A1* | 7/2010 | Barrett | B60H 1/00871 236/49.3 |
| 2010/0211224 | A1 | 8/2010 | Keeling et al. | |
| 2013/0036311 | A1* | 2/2013 | Akyol | H04L 63/08 713/189 |
| 2013/0066482 | A1* | 3/2013 | Li | H02J 3/14 700/297 |
| 2013/0085614 | A1* | 4/2013 | Wenzel | F24F 11/006 700/277 |
| 2013/0197698 | A1* | 8/2013 | Shah | F24F 11/0009 700/276 |
| 2013/0218360 | A1* | 8/2013 | Najewicz | G05B 15/02 700/294 |
| 2013/0282181 | A1* | 10/2013 | Lu | H02J 3/14 700/275 |
| 2014/0096946 | A1* | 4/2014 | Rognli | F24F 11/006 165/209 |

OTHER PUBLICATIONS

"Introduction to Commercial Building Control Strategies and Techniques for Demand Response" by Motegi et al., Demand Response Research Center, May 22, 2007.

"Critical Infrastructure Protection through Distributed Reactive Demand-Side Management" by Hildmann et al., 6th International Conference on Internet Technology and Secured Transactions, Dec. 11-14, 2011, Abu Dhabi, United Arab Emirates.

"Influence of Variable Supply and Load Flexibility on Demand-Side Management" by Hildmann et al., 8th International Conference on the European Energy Market (EMM), May 25-27, 2011, Zagreb, Croatia.

"Simulating stochastic activation functions" by Hildmann et al. Conference Aug. 20-23, 2013.

"Modeling Quality of Service vs Peak Reduction trade-offs in A/C-based Demand-Side Management" by Saffre et al., IEEE First International Workshop on Smart Grid Modeling and Simulation (SGMS) at IEEE SmartGridComm 2011.

"Demand-Side Management for Air Conditioning" by Hildmann et al., 6th International Conferenece on Internet Technology and Secured Transactions, Dec. 11-14, 2011, Abu Dhabi, United Arab Emirates.

* cited by examiner

METHOD AND SYSTEM FOR CONTROLLING CONSUMPTION

FIELD OF THE INVENTION

The present invention relates to methods and systems for controlling consumption, particularly power consumption. It is particularly, but not exclusively, concerned with controlling power consumption of climate control devices in a building whilst maintaining a certain level of comfort within the building.

BACKGROUND OF THE INVENTION

Building Management Systems (BMS) are well established and are used to control heating and air conditioning (AC) infrastructure so as to ensure the comfort of building inhabitants as well as to achieve other goals such as cooling of ICT equipment. In the business and corporate environment, BMS are available that can be used to obtain sensor data and set control values such as thermostat set points, remotely (e.g. see: https://www.trendcontrols.com/en-GB/Pages/default.aspx)

In tandem with this, energy savings (and associated cost savings) have become an important goal in recent years. Clearly there can be a trade-off between energy saving and controlling temperature using HVAC (heating, ventilation and air-conditioning) systems under BMS control. For example, reducing a thermostat setting by one degree in the UK winter will save energy, but it will typically lead to a higher percentage of dissatisfied building inhabitants.

The broader context of energy saving is energy management (EM). Here the goal is not just to reduce energy but rather to manage the consumption of energy over time to achieve certain goals. Specifically techniques such as Demand Side Management (DSM) or Demand Response (DR) can be used to time-shift energy consumption, typically to avoid peaks in energy consumption, so as to help balance energy consumption with available energy supply. Peak periods of energy consumption in the UK and many other countries equate to more costly energy generation, so reduction of demand peaks (which would otherwise exceed normally available supply) can result in avoiding buying energy at the most costly time or can result in being paid revenue by the energy provider or networks (National Grid in the UK) so that they can similarly avoid direct costs themselves. An example of this is UK National Grid's Short Term Operating Reserve (STOR) scheme.

Note that when applying climate control to buildings there is a desire to control "thermal comfort" which has been defined by the American Society of Heating, Refrigerating and Air-Conditioning Engineers (ASHRAE). A model for thermal comfort is captured in terms of PMV (predicted mean vote) and PPD (predicted percent dissatisfied) measures via equations defined in ISO 7730. This model has been used, with respect to temperature variability, to inform the measure of temperature-drift-related discomfort discussed later.

The Demand Response Research Center (DRRC, Lawrence Berkeley National Laboratory) has published a comprehensive report "Introduction to Commercial Building Control Strategies and Techniques for Demand Response": http://gaia.lbl.gov/btech/papers/59975.pdf This guide gives a good summary of available approaches and in particular discusses the following DR strategies for HVAC systems:

Global Temperature Adjustment of Zones

Systemic Adjustments to the Air Distribution and/or Cooling Systems.

Section 3.4.1 of this report states that: "Demand limit strategy is a supervisory control algorithm that manages a combination of single or multiple DR control strategies. When the whole building demand exceeds a warning level, the EMCS deploys strategy #1. If the whole building demand still exceeds the warning level, strategy #2 is deployed, and so on. Thus, whenever the demand hits the warning level, the whole building demand is suppressed by a combination of sequential strategies. Strategies that have a lower impact on occupants' comfort should come first, and strategies that have more impact should come later. When the demand goes below the lower deadband level, the last strategy should be deployed. For any strategy that may have a risk of causing a rebound peak, slow recovery strategies must be considered.

Demand limit strategy has been considered as a method to avoid high demand charges during normal operation, rather than as a demand response strategy. However, depending on the structure of demand response programs, demand limit strategy can be a very useful tool to achieve desired kW savings. For example, demand bidding programs offered by many utility companies require curtailing a preset kW demand against a baseline defined by each utility. If the EMCS has a function to develop dynamic demand limit setpoints based on the baseline, the demand limit target can be set as shown in Equation 1, so that the desired demand savings can always be achieved.

$$[\text{Demand limit target}]=[\text{Baseline}]-[\text{Desired demand savings}]" \qquad \text{Equation 1}$$

Control of HVAC units/infrastructure has been proposed that is sensitive to occupancy of buildings. E.g. "Occupancy Based Demand Response HVAC Control Strategy" at http://andes.ucmerced.edu/papers/Erickson10a.pdf. This can help promote energy saving but does not seek to meet a specific energy cap.

In WO/2009/122173, one of the inventors of the present application set out a method of scheduling usage of resources to provide for a degree of DSM.

It is an object of the present invention to provide a building management system, a method of operation and individual climate control appliances which provide an overall cap on the power consumption whilst maintaining a desired level of comfort within the area being controlled.

Whilst the aims of the present invention are most relevant to commercial buildings, they could in principle be applied in a residential context too, where the goal might be to meet an energy cap across a number of rooms or more likely a number of households. In the latter case it might be part of a lower tariff energy package where DR is permitted by a householder so as to have a better deal on energy costs.

Aspects of the present invention could also be used to help identify and prioritise which rooms or areas within a building which could have reduced A/C (or heating, or other climate control) whilst still maintaining an acceptable temperature range, thereby contributing into a DR/DSM scheme.

SUMMARY OF THE INVENTION

An exemplary embodiment of the invention provides a method of controlling power consumption in a plurality of climate control appliances, each of which is connected to a plurality of neighbouring appliances and has a running cycle of predetermined length, the method including the steps of: setting a cap for the power consumption of each group of appliances comprising an appliance and its neighbours; setting a threshold value for a climate parameter separating values for said parameter into a preferred direction and a non-preferred direction; and when a first of said climate control appliances reaches the end of its running cycle:

measuring a climate parameter associated with the area around said first climate control appliance; the first climate control appliance determining whether being inactive for the following running cycle will result in said climate parameter falling on the preferred side of said threshold value; if so, said first appliance being placed in an inactive state for its next running cycle; if not, the first appliance: causing each of its neighbouring appliances which is currently active to determine the climate parameter associated with the area around that appliance at the end of its current running cycle if the appliance was to become inactive; determining a subset of the first appliance and the currently active neighbouring appliances which should be active, the subset being those appliances for which the determined climate parameter is least preferred and the number of appliances in said subset being selected so as to ensure that said cap is not exceeded.

A further exemplary embodiment of the invention provides a climate control appliance which is connected to a plurality of neighbouring climate control appliances and has a running cycle of predetermined length, the climate control appliance having a processor which is arranged to: when said climate control appliance reaches the end of its running cycle: measure a climate parameter associated with the area around said climate control appliance; determine whether being inactive for the following running cycle will result in said climate parameter falling on the preferred side of a predetermined threshold value for said climate parameter which separates values for said parameter into a preferred direction and a non-preferred direction; if so, place said appliance in an inactive state for its next running cycle; if not: communicate with each of its neighbouring appliances which is currently active to cause those appliances to determine the climate parameter associated with the area around that appliance at the end of its current running cycle if the appliance was to become inactive; and determine a subset of said appliance and the currently active neighbouring appliances which should be active, the subset being those appliances for which the determined climate parameter is least preferred and the number of appliances in said subset being selected so as to ensure that a predetermined cap for the power consumption of the group of appliances comprising said appliance and its neighbours is not exceeded.

A further exemplary embodiment of the invention provides a building management system comprising a plurality of climate control appliances each of which is connected to a plurality of neighbouring appliances and having a running cycle of predetermined length, each climate control appliance having a processor which is arranged to: when said climate control appliance reaches the end of its running cycle: measure a climate parameter associated with the area around said climate control appliance; determine whether being inactive for the following running cycle will result in said climate parameter falling on the preferred side of a predetermined threshold value for said climate parameter which separates values for said parameter into a preferred direction and a non-preferred direction; if so, place said appliance in an inactive state for its next running cycle; if not: communicate with each of its neighbouring appliances which is currently active to cause those appliances to determine the climate parameter associated with the area around that appliance at the end of its current running cycle if the appliance was to become inactive; and determine a subset of said appliance and the currently active neighbouring appliances which should be active, the subset being those appliances for which the determined climate parameter is least preferred and the number of appliances in said subset being selected so as to ensure that a predetermined cap for the power consumption of the group of appliances comprising said appliance and its neighbours is not exceeded.

BRIEF DESCRIPTION OF THE DRAWINGS

Embodiments of the invention will now be described by way of example with reference to the accompanying drawings in which.

DETAILED DESCRIPTION

Figure 1:
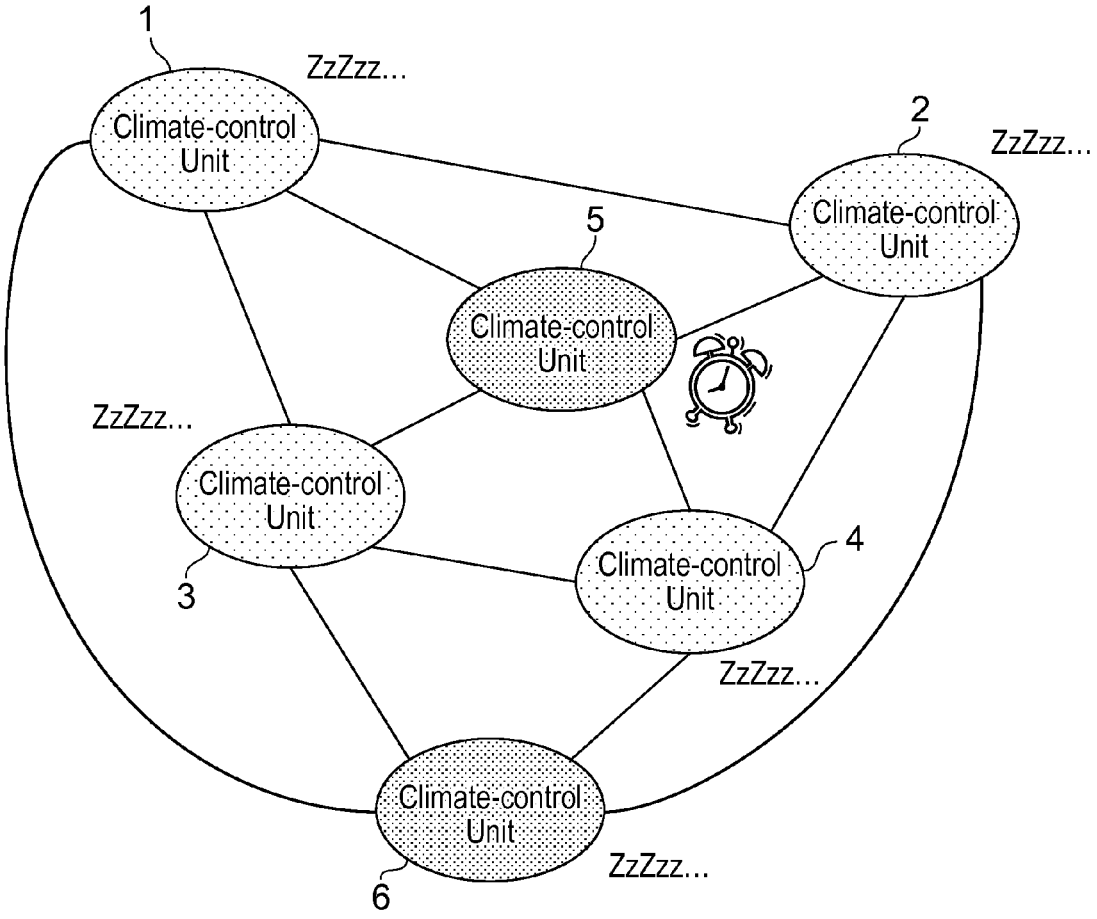
FIGS. 1 to 5 show, in schematic form, a plurality of climate control devices according to an embodiment of the present invention and the operation of a method according to a further embodiment of the present invention for controlling the power consumption of those devices.

At their broadest, methods of the present invention provide a method of controlling power consumption in a plurality climate control appliances by imposing a local cap and thereby probabilistically limit the aggregated power load of the plurality of climate control appliances, whilst seeking to minimize the deviation from target environmental conditions.

A first aspect of the present invention provides a method of controlling power consumption in a plurality of climate control appliances, each of which is connected to a plurality of neighbouring appliances and has a running cycle of predetermined length, the method including the steps of: setting a cap for the power consumption of each group of appliances comprising an appliance and its neighbours; setting a threshold value for a climate parameter separating values for said parameter into a preferred direction and a non-preferred direction; and when a first of said climate control appliances reaches the end of its running cycle: measuring a climate parameter associated with the area around said first climate control appliance; the first climate control appliance determining whether being inactive for the following running cycle will result in said climate parameter falling on the preferred side of said threshold value; if so, said first appliance being placed in an inactive state for its next running cycle; if not, the first appliance: causing each of its neighbouring appliances which is currently active to determine the climate parameter associated with the area around that appliance at the end of its current running cycle if the appliance was to become inactive; determining a subset of the first appliance and the currently active neighbouring appliances which should be active, the subset being those appliances for which the determined climate parameter is least preferred and the number of appliances in said subset being selected so as to ensure that said cap is not exceeded.

The climate parameter may be, for example, temperature, humidity or airflow. The climate control appliances may be, for example, heaters, chillers, air conditioning units, humidifiers, driers, air vents, or controllable window blinds.

The method of this aspect can make use of dynamic and fine-grained local decision-making, informed by real-time sensor readings. This means that the method can take into account special, changing and/or unforeseen circumstances in individual rooms or areas, which cannot be done by applying a sequence of pre-calculated policies.

Although the main objective of the method is to (probabilistically) enforce a power cap, the technique also aims to simultaneously minimize discomfort of occupants which arises due to local temperatures (or other climate conditions) drifting too far from desired (specified) levels. In this regard the inventors have discovered that extremes of temperature variation are reduced by applying a method embodying this aspect, when compared to say simply changing local thermostat set points by a fixed amount such as 1 degree C.

By using distributed decision making, including a projection-based local decision mechanism, this method may avoid unnecessary temperature "overshoot" by taking account of (inferable) thermal parameters of heat loss/gain rates from the area surrounding each appliance.

The method of this aspect ensures that the target cap (which can be expressed, for example, as the fraction of appliances allowed to operate concurrently) is locally enforced, which leads to the same proportional target cap (proportion of active appliances) being closely approximated on a global level.

In a development of this aspect, as well as setting a power cap, it is also possible to set a discomfort threshold which if breached could be used to alert a central or wider building management system to enact other demand reduction strategies, which may include a general, or local relaxation of the cap.

Overall the method of the present aspect is likely to lead to some overall energy savings as the climate parameter is allowed to drift during periods of power capping, reducing total consumption by the appliances. After applying the method of this aspect for some time it may be discovered that apparent discomfort is in fact at an acceptable level in some zones, which could lead to longer term adjustments and energy savings becoming possible.

As it is based at an appliance level, the method of the present aspect can take into account the influence of external factors and variables (e.g. temperature) on the priority level of "competing" processes. By contrast, in the prior art, typically only the aggregated load/price was taken into consideration to determine if a particular process/load was allowed to start.

These differences can be seen from way in which the present aspect uses direct "negotiation" between the first appliance and its neighbours. Prioritization of operation can therefore be determined on a one-to-one basis (as opposed to being the result of what amounts to a "one-to-many" comparison).

The method of the present aspect also allows for interrupting one or more on-going processes if it is determined that this is required for the greater good of the first appliance and its neighbours.

Preferably the method further includes the step of placing all appliances in said group which are not in said determined subset in an inactive state.

In a preferred implementation of this aspect the step of causing involves the sub-step of: the first climate control appliance sending a message to each of its neighbouring appliances, and the step of determining involves the sub-steps of: each neighbouring appliance which is currently active sending the results of its determination to the first appliance; and the first appliance communicating an instruction to become inactive to any currently active appliance which is not in said subset.

The method may further include the steps of: determining the occupancy of an area served by at least one of said climate control appliances; and setting said cap for the group of appliances comprising said at least one climate control appliance based on said determination of occupancy. By determining the occupancy of an area or zone, it may be possible to identify areas or zones for which the climate control is not currently necessary. Such areas or zones could then be given lower local caps (or all appliances in that area could be switched off) and the remaining occupied zones have their caps increased accordingly whilst maintaining an overall cap on the demand.

The method may further include the step of adjusting said cap for one or more of said groups of appliances or removing said cap for one or more of said groups of appliances by incrementally increasing said cap over a predetermined period of time. In this way, the method may allow for a controlled relaxation of the cap. For example, after a period of power capping, the cap may be removed entirely. However, it may be desirable to avoid a rapid "rebound" which may result in an energy demand spike as a result of all (or a large proportion) of appliances switching on as soon as the cap is removed. Therefore the method may be arranged to remove a cap in stages by adjusting the capping level over a period of time.

The cap may be dynamically adjusted to match the demand level of said plurality of climate control appliances to a time-varying power supply level. A particular implementation of this would be to dynamically match demand levels to time-varying changes in supply levels from local renewable sources. The output from renewable energy sources (e.g. solar panels, wind generators) can be very variable and matching demand levels to those supply levels by dynamically varying the cap applied can maximise the use of those sources.

The method of the present aspect may include any combination of some, all or none of the above described preferred and optional features.

The methods of the above aspect is preferably implemented by a climate control appliance according to the second aspect of this invention and/or in a building management system according to the third aspect of this invention, as described below, but need not be.

Further aspects of the present invention include computer programs for running on computer systems which carry out the methods of the above aspect, including some, all or none of the preferred and optional features of that aspect.

At their broadest, devices of the present invention provide climate control appliances which are arranged to collectively control their power consumption to a selected value, whilst seeking to minimize the deviation from target environmental conditions.

A second aspect of the present invention provides a climate control appliance which is connected to a plurality of neighbouring climate control appliances and has a running cycle of predetermined length, the climate control appliance having a processor which is arranged to: when said climate control appliance reaches the end of its running cycle: measure a climate parameter associated with the area around said climate control appliance; determine whether being inactive for the following running cycle will result in said climate parameter falling on the preferred side of a predetermined threshold value for said climate parameter which separates values for said parameter into a preferred direction and a non-preferred direction; if so, place said appliance in an inactive state for its next running cycle; if not: communicate with each of its neighbouring appliances which is currently active to cause those appliances to determine the climate parameter associated with the area around that appliance at the end of its current running cycle if the appliance was to become inactive; and determine a subset of said appliance and the currently active neighbouring appliances which should be active, the subset being those appliances for which the determined climate parameter is least preferred and the number of appliances in said subset being selected so as to ensure that a predetermined cap for the power consumption of the group of appliances comprising said appliance and its neighbours is not exceeded.

The climate parameter may be, for example, temperature, humidity or airflow. The climate control appliances may be, for example, heaters, chillers, air conditioning units, humidifiers, driers, air vents, or controllable window blinds.

The climate control appliance of this aspect can make use of dynamic and fine-grained local decision-making, informed by real-time sensor readings. This means that the climate control appliance can take into account special, changing and/or unforeseen circumstances in individual rooms or areas, which cannot be done by applying a sequence of pre-calculated policies.

Although the main objective of the climate control appliance is to (probabilistically) enforce a power cap, the technique also aims to simultaneously minimize discomfort of occupants which arises due to local temperatures (or other climate conditions) drifting too far from desired (specified) levels. In this regard the inventors have discovered that extremes of temperature variation are reduced by using climate control appliances embodying this aspect, when compared to say simply changing local thermostat set points by a fixed amount such as 1 degree C.

By using distributed decision making, including a projection-based local decision mechanism, this climate control appliance may avoid unnecessary temperature "overshoot" by taking account of (inferable) thermal parameters of heat loss/gain rates from the area surrounding each appliance.

The climate control appliance of this aspect ensures that the target cap (which can be expressed, for example, as the fraction of appliances allowed to operate concurrently) is locally enforced, which leads to the same proportional target cap (proportion of active appliances) being closely approximated on a global level.

In a development of this aspect, as well as setting a power cap, it is also possible to set a discomfort threshold which if breached could be used to alert a central or wider building management system to enact other demand reduction strategies, which may include a general, or local relaxation of the cap.

Overall the climate control appliance of the present aspect is likely to lead to some overall energy savings as the climate parameter is allowed to drift during periods of power capping, reducing total consumption by the appliances. After using climate control appliances of this aspect for some time it may be discovered that apparent discomfort is in fact at an acceptable level in some zones, which could lead to longer term adjustments and energy savings becoming possible.

As it is based at an appliance level, the present aspect can take into account the influence of external factors and variables (e.g. temperature) on the priority level of "competing" processes. By contrast, in the prior art, typically only the aggregated load/price was taken into consideration to determine if a particular process/load was allowed to start.

These differences can be seen from way in which the present aspect uses direct "negotiation" between the appliance and its neighbours. Prioritization of operation can therefore be determined on a one-to-one basis (as opposed to being the result of what amounts to a "one-to-many" comparison).

The climate control appliance of the present aspect can also interrupt one or more on-going processes if it is determined that this is required for the greater good of the appliance and its neighbours.

In a preferred implementation of this aspect the processor is further arranged to: send and receive messages to/from each of the neighbouring appliances, said messages including: an instruction for the neighbouring appliance to determine the climate parameter associated with the area around that appliance at the end of its current running cycle if the appliance was to become inactive; the results of such a determination; and an instruction to a selected a currently active appliance which is not in said subset to become inactive.

The climate control appliance may further include an occupancy determination sensor which is arranged to determine the occupancy of an area served by said climate control appliance, and wherein the processor is further arranged to set said cap for the group of appliances comprising said climate control appliance based on said determination of occupancy. By determining the occupancy of an area or zone, it may be possible to identify areas or zones for which the climate control is not currently necessary. Such areas or zones could then be given lower local caps (or all appliances in that area could be switched off) and the remaining occupied zones have their caps increased accordingly whilst maintaining an overall cap on the demand.

The processor may be arranged to receive an instruction from an external controller to adjust said cap to a new level, or to remove said cap, and to respond to said instruction by incrementally increasing said cap over a predetermined period of time. In this way, the appliance may allow for a controlled relaxation of the cap. For example, after a period of power capping, the cap may be removed entirely. However, it may be desirable to avoid a rapid "rebound" which may result in an energy demand spike as a result of all (or a large proportion) of appliances switching on as soon as the cap is removed. Therefore the appliance may be arranged to remove a cap in stages by adjusting the capping level over a period of time.

The cap may be dynamically adjusted to match the demand level of said plurality of climate control appliances to a time-varying power supply level. A particular implementation of this would be to dynamically match demand levels to time-varying changes in supply levels from local renewable sources. The output from renewable energy sources (e.g. solar panels, wind generators) can be very variable and matching demand levels to those supply levels by dynamically varying the cap applied can maximise the use of those sources.

The climate control appliance of this aspect preferably operates by carrying out the relevant steps of a method according to the first aspect described above.

The climate control appliance of the present aspect may include any combination of some, all or none of the above described preferred and optional features.

At their broadest, systems of the present invention provide a building management system which is arranged to control the power consumption of a plurality of climate control appliances to a selected value by localised capping, whilst seeking to minimize the deviation from target environmental conditions.

A third aspect of the present invention provides a building management system comprising a plurality of climate control appliances each of which is connected to a plurality of neighbouring appliances and having a running cycle of predetermined length, each climate control appliance having a processor which is arranged to: when said climate control appliance reaches the end of its running cycle: measure a climate parameter associated with the area around said climate control appliance; determine whether being inactive for the following running cycle will result in said climate parameter falling on the preferred side of a predetermined threshold value for said climate parameter which separates values for said parameter into a preferred direction and a non-preferred direction; if so, place said appliance in an inactive state for its next running cycle; if not: communicate with each of its neighbouring appliances which is currently active to cause those appliances to determine the climate parameter associated with the area around that appliance at the end of its current running cycle if the appliance was to become inactive; and determine a subset of said appliance and the currently active neighbouring appliances which should be active, the subset being those appliances for which the determined climate parameter is least preferred and the number of appliances in said subset being selected so as to ensure that a predetermined cap for the power consumption of the group of appliances comprising said appliance and its neighbours is not exceeded.

The climate parameter may be, for example, temperature, humidity or airflow. The climate control appliances may be, for example, heaters, chillers, air conditioning units, humidifiers, driers, air vents, or controllable window blinds.

Preferably all appliances in said group which are not in said determined subset are placed in an inactive state.

The climate control appliance of this aspect can make use of dynamic and fine-grained local decision-making, informed by real-time sensor readings. This means that the climate control appliance can take into account special, changing and/or unforeseen circumstances in individual rooms or areas, which cannot be done by applying a sequence of pre-calculated policies.

Although the main objective of the climate control appliance is to (probabilistically) enforce a power cap, the technique also aims to simultaneously minimize discomfort of occupants which arises due to local temperatures (or other climate conditions) drifting too far from desired (specified) levels. In this regard the inventors have discovered that extremes of temperature variation are reduced by using climate control appliances embodying this aspect, when compared to say simply changing local thermostat set points by a fixed amount such as 1 degree C.

By using distributed decision making, including a projection-based local decision mechanism, this climate control appliance may avoid unnecessary temperature "overshoot" by taking account of (inferable) thermal parameters of heat loss/gain rates from the area surrounding each appliance.

The climate control appliance of this aspect ensures that the target cap (which can be expressed, for example, as the fraction of appliances allowed to operate concurrently) is locally enforced, which leads to the same proportional target cap (proportion of active appliances) being closely approximated on a global level.

In a development of this aspect, as well as setting a power cap, it is also possible to set a discomfort threshold which if breached could be used to alert a central or wider building management system to enact other demand reduction strategies, which may include a general, or local relaxation of the cap.

Overall the climate control appliance of the present aspect is likely to lead to some overall energy savings as the climate parameter is allowed to drift during periods of power capping, reducing total consumption by the appliances. After using climate control appliances of this aspect for some time it may be discovered that apparent discomfort is in fact at an acceptable level in some zones, which could lead to longer term adjustments and energy savings becoming possible.

As it is based at an appliance level, the present aspect can take into account the influence of external factors and variables (e.g. temperature) on the priority level of "competing" processes. By contrast, in the prior art, typically only the aggregated load/price was taken into consideration to determine if a particular process/load was allowed to start.

These differences can be seen from way in which the present aspect uses direct "negotiation" between the appliance and its neighbours. Prioritization of operation can therefore be determined on a one-to-one basis (as opposed to being the result of what amounts to a "one-to-many" comparison).

The climate control appliance of the present aspect can also interrupt one or more on-going processes if it is determined that this is required for the greater good of the appliance and its neighbours.

In a preferred implementation of this aspect the processor of each device is further arranged to: send and receive messages to/from each of the neighbouring appliances, said messages including: an instruction for the neighbouring appliance to determine the climate parameter associated with the area around that appliance at the end of its current running cycle if the appliance was to become inactive; the results of such a determination; and an instruction to a selected a currently active appliance which is not in said subset to become inactive, and wherein: a first climate control appliance which has reached the end of its running cycle is arranged to send a message to each of its neighbouring appliances; each neighbouring appliance which is currently active is arranged to send the results of its determination to the first appliance; and the first appliance is arrange to communicate an instruction to become inactive to any currently active appliance which is not in said subset.

Each appliance may further include an occupancy determination sensor which is arranged to determine the occupancy of an area served by said climate control appliance, and wherein the processor is further arranged to set said cap for the group of appliances comprising said climate control appliance based on said determination of occupancy. By determining the occupancy of an area or zone, it may be possible to identify areas or zones for which the climate control is not currently necessary. Such areas or zones could then be given lower local caps (or all appliances in that area could be switched off) and the remaining occupied zones have their caps increased accordingly whilst maintaining an overall cap on the demand.

The building management system may further include a controller for said climate control appliances, wherein the processor of each appliance is arranged to receive an instruction from an external controller to adjust said cap to a new level, or to remove said cap, and to respond to said instruction by incrementally increasing said cap over a predetermined period of time. For example, after a period of power capping, the cap may be removed entirely. However, it may be desirable to avoid a rapid "rebound" which may result in an energy demand spike as a result of all (or a large proportion) of appliances switching on as soon as the cap is removed. Therefore the appliance may be arranged to remove a cap in stages by adjusting the capping level over a period of time.

The building management system may further include a controller for said climate control appliances, wherein said controller is arranged to dynamically adjust said cap to match the demand level of said plurality of climate control appliances to a time-varying power supply level. A particular implementation of this would be to dynamically match demand levels to time-varying changes in supply levels from local renewable sources. The output from renewable energy sources (e.g. solar panels, wind generators) can be very variable and matching demand levels to those supply levels by dynamically varying the cap applied can maximise the use of those sources.

The system of this aspect preferably operates by carrying out a method according to the above described first aspect.

The system of the present aspect may include any combination of some, all or none of the above described preferred and optional features.

A Building Management System (BMS) is designed to orchestrate operation of a variety of appliances in order to meet certain targets (in terms, e.g., of power consumption and/or environmental conditions), usually specified in the form of policies.

The embodiments of the present invention provide methods for probabilistically limiting (i.e. capping) the aggregated power load of a population of climate control appliances (such as heaters and/or air-conditioning units) to an arbitrary value, whilst minimizing deviation from target environmental conditions and hence inconvenience to the occupants of the building.

For the sake of clarity the embodiments described herein will solely relate to situations in which each climate control appliance is a heating device and the affected environmental condition is temperature. However, it will be understood that the same techniques could be readily applied to control other variables (or a combination of such variables) including, but not limited to, humidity or brightness, and to other appliances. It will also be understood that, in certain circumstances, it will be desired to keep the environmental condition in question above a certain level (e.g. the temperature when the predominant requirement is for heating of the building in a cold climate), whilst in other circumstances it will be desired to keep the environmental condition below a certain level (e.g. the temperature when the predominant requirement is for the cooling or air conditioning of a building in a hot climate). In certain implementations, the BMS may be adjustable to deal with both such conditions (or a plurality of such conditions), for example as a result of seasonal variations in temperature or humidity.

The operation of a building management system according to an embodiment of the present invention is shown schematically in FIGS. 1-5. In the building management method according to an embodiment of the invention which is implemented by the BMS, every climate-control appliance makes an independent decision to switch/stay on/off based on the expected or projected deviation from a target in either case after a certain period of (in)activity.

So instead of simply relying on a thermostat which would switch on the heater as soon as the temperature reading falls below a certain value and switch it off when exceeding it, each appliance is able to determine whether running for a certain period will bring the area that it affects further from or closer to a target than remaining inactive for the same amount of time.

This local decision is completely asynchronous in that it does not require different appliances to complete their operation cycle at the same time. Instead a device reaching the end of its cycle (subsequently referred to as the "trigger") and choosing to switch/stay on will force a check of the local neighborhood (itself and its logical neighbors).

FIG. 1 shows an example situation in a network of six climate-control (heating) units 1-6. Each unit is directly connected to four other units which are considered to be its immediate "neighbour" units.

In the state shown in FIG. 1, four of the units (1-4) are active, whilst the remaining two (5 & 6) are inactive. For the purposes of this embodiment, a power "cap" of 80% is stipulated by the BMS. It can be seen that for any selected unit and its immediate neighbours, in the situation shown in FIG. 1, this power cap is observed.

At the point shown in FIG. 1, one of the inactive units (shown by reference 5) has reached the end of its operation cycle and determines that, if it was to stay inactive for a further cycle, its local temperature would be below the target temperature. Furthermore, this unit 5 determines that if it was to simply activate itself, then the power cap of 80% would be exceeded as all of the unit's immediate neighbour units 1-4 are currently active.

A unit may be aware of the status of its neighbouring units in a number of ways. For example, a unit may keep a record based on the history of activation of units. In another example, each unit which reaches the end of its cycle activates itself briefly before going back to sleep if it is determined that the unit should be inactive for the next cycle (see below). Each unit communicates a change in its status to its neighbouring units and therefore the neighbouring units will become aware of the status.

It is noted that the building management system and method of this embodiment may result in both local and potentially global overshoot of the cap. For example it is possible that whilst a unit is permitted to activate based on an analysis of the activity of its neighbouring units, this may result in one or more of its neighbouring units ending up in a group of its own neighbouring units which exceeds the cap. However, this situation will be rectified when an active unit in a group of units which has overshot the cap next reaches the end of its cycle. Moreover, when averaged over all of the units under the control of the building management system, such local variations may average out in most circumstances.

Figure 2:
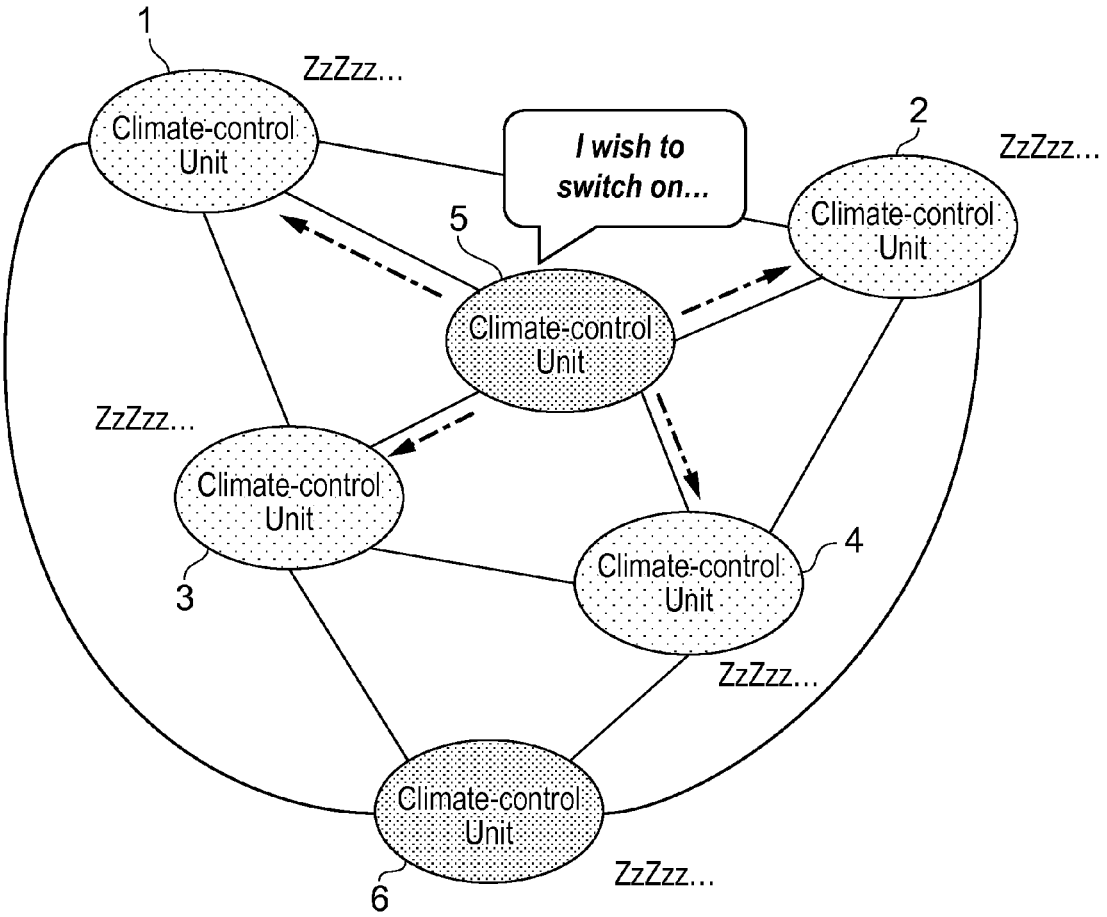

As such, this unit 5 acts as the local trigger and communicates with its desire to switch on/remain on to its immediate neighbour units 1-4 (as shown in FIG. 2). The asynchronous nature of the decision making in this embodiment is illustrated in FIG. 2 as all the neighbouring units 1-4 are not at their cycle end, but respond to the trigger action from the trigger unit 5.

Figure 3:
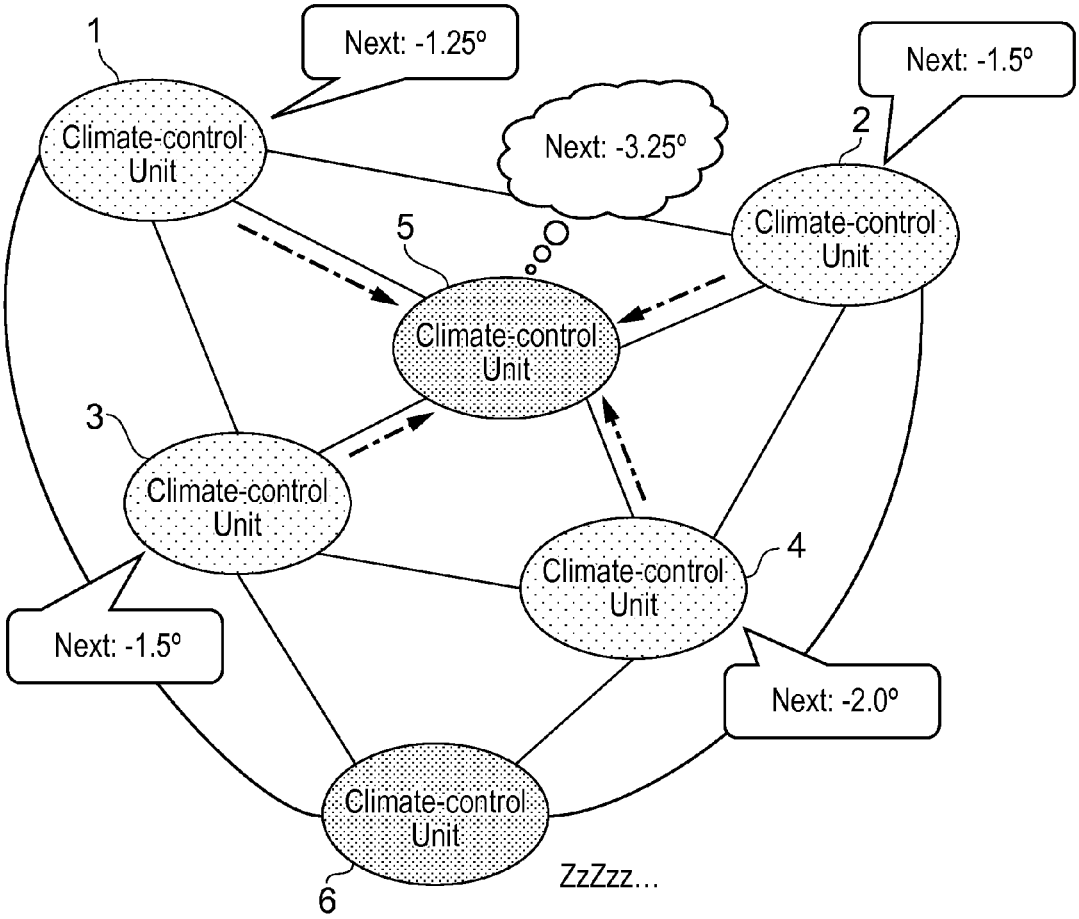
Figure 4:
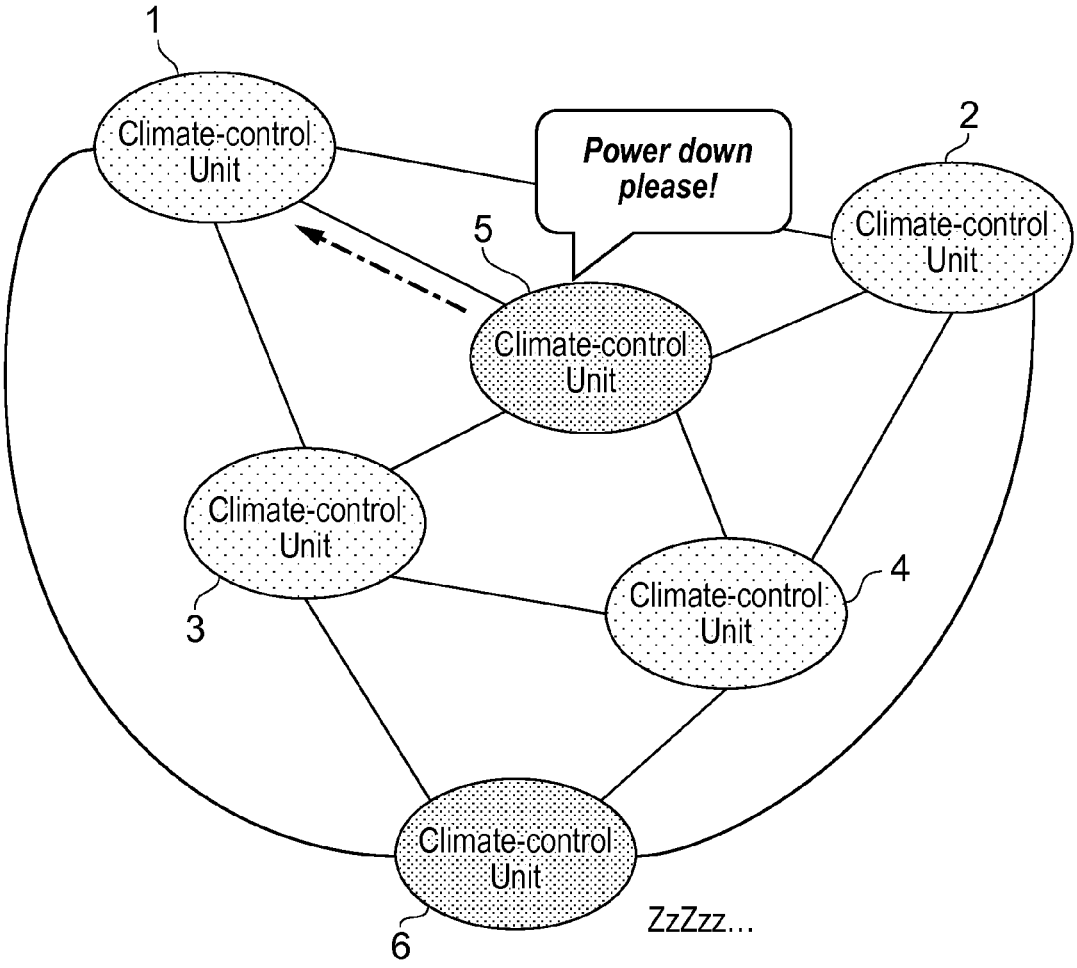
Figure 5:
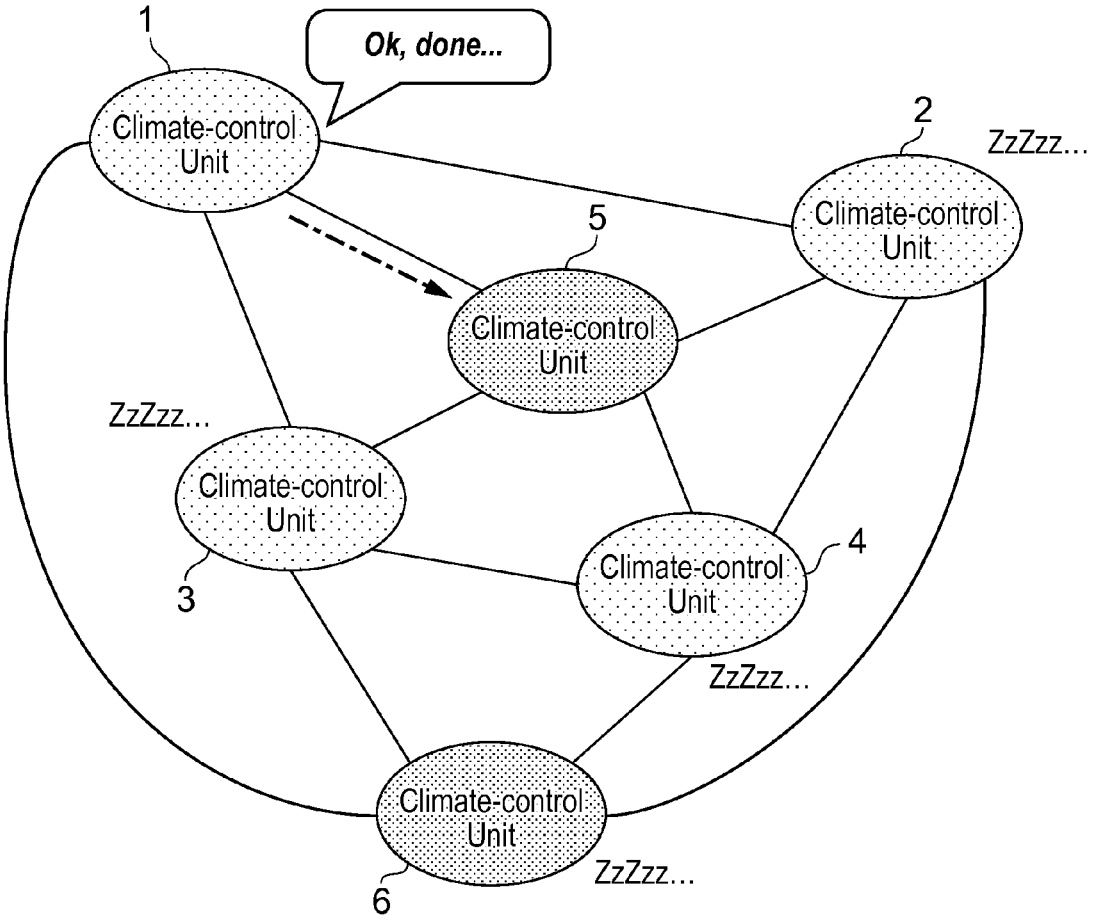

As shown in FIG. 3, in response to the trigger action from the trigger unit 5, each of the neighbour units 1-4 and the trigger unit 5 calculate the effect on their local temperature if they were to change their state to inactive (or remain inactive) until the end of their current cycle. These results are communicated back to the trigger unit 5. In this embodiment and example shown in FIG. 3, all of the neighbour units 1-4 make this calculation and communicate the results to the trigger unit. However, it is only necessary that the currently active units communicate this information as the subsequent selection of which unit(s) power down and/or remain inactive is only made between those units.

If the number of active appliances or the number of appliances desiring to be active is found to exceed the cap locally (i.e. within the trigger unit and its neighbours), a collective decision process is initiated to identify the sub-set of appliances that can be switched off and result in the lowest possible inconvenience (i.e., in this embodiment, the negative drift from the desired temperature set-point).

Having received the calculations from its neighbouring units, the trigger unit 5 determines how many of the units can be active for the cap to be respected and how many of the units are currently active or desire to be active (based on the calculations received). The trigger unit 5 then sorts the projections received (including its own) by order of increasing occupant inconvenience (i.e. deviation from the set-point). The trigger unit 5 then determines that the first n units in the resulting list should be powered down/remain inactive (where n=Number of active units−Cap). Finally, the trigger unit 5 sends a "switch off" message to the identified units (see FIG. 4—if the only identified unit is the trigger unit 5 itself, then no message is required and the trigger unit 5 either powers down, or remains inactive for the next cycle).

It will be appreciated that other methods of performing this determination could be used, and the above method is given by way of example only.

In a final step, if the trigger unit 5 has determined that it should be amongst the units to be active, then, once it has determined that all units to which the "switch off" message has been sent have indeed powered down, the trigger unit 5 itself can power up and the local cap will be respected. This determination may be as a result of reply messages from the units powering down, or as a result of the trigger unit 5 being able to detect the change in status of the relevant neighbour unit(s).

In further embodiments, the system may also include occupation sensors (for example PIR devices) which could identify zones for which comfort control is no longer necessary. These zones could be given lower local caps (or all appliances in that area could be switched off) and the remaining occupied zones have their caps increased accordingly.

In other embodiments the system may allow for a controlled relaxation of a consumption cap. After a period of power capping (for example to meet a particular consumption target within a specified period), the cap may be removed entirely. However, it is often desirable to avoid a rapid "rebound" which may result in an energy demand spike as a result of all (or a large proportion) of appliances switching on as soon as the cap is removed. Therefore the system may be arranged to remove a cap in stages by adjusting the capping level over a period of time. For example, from a cap of 70% of appliances active, the system may increase the cap to 80% of appliances active for the 30 minute period immediately after the cap has been removed and to 90% of appliances active for the next 30 minute period, before uncapped operation (i.e. operation driven only by the comfort parameter requirements) thereafter.

The system could also be used to dynamically match demand levels in the building to time-varying changes in supply levels from local renewable sources. The output from renewable energy sources (e.g. solar panels, wind generators) can be very variable and matching demand levels to those supply levels by dynamically varying the cap applied can maximise the use of those sources.

In such scenarios, a degree of centralised control may be required and so the building management system may include a controller. However, aside from communicating changes in the cap to the units, the central controller generally does get involved in the decision-making about which appliances are active at any particular time.

In some embodiments, it may also be provided that each appliance, or a number of the units, selected such that at least one appliance in each group of neighbouring appliances is contained in that number, has a controller which is able to make an independent decision about the cap value to be applied in that group based on local information (e.g. from a sensor or data-feed from the local renewable sources as to the level of supply).

The system may provide for additional or alternative demand reduction initiatives when a threshold level of discomfort is reached (as measured by the climate parameter).

The system may also allow over-riding of the power cap in the event that a threshold discomfort level is reached, either in the building as a whole, or within a specified zone of a building. This provides for a trade-off in extreme climatic circumstances.

The systems and methods of the above embodiments may be implemented in a computer system (in particular in computer hardware or in computer software) in addition to the structural components and user interactions described.

The term "computer system" includes the hardware, software and data storage devices for embodying a system or carrying out a method according to the above described embodiments. For example, a computer system may comprise a central processing unit (CPU), input means, output means and data storage. Preferably the computer system has a monitor to provide a visual output display (for example in the design of the business process). The data storage may comprise RAM, disk drives or other computer readable media. The computer system may include a plurality of computing devices connected by a network and able to communicate with each other over that network.

The methods of the above embodiments may be provided as computer programs or as computer program products or computer readable media carrying a computer program which is arranged, when run on a computer, to perform the method(s) described above.

The term "computer readable media" includes, without limitation, any non-transitory medium or media which can be read and accessed directly by a computer or computer system. The media can include, but are not limited to, magnetic storage media such as floppy discs, hard disc storage media and magnetic tape; optical storage media such as optical discs or CD-ROMs; electrical storage media such as memory, including RAM, ROM and flash memory; and hybrids and combinations of the above such as magnetic/optical storage media.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

In particular, although the methods of the above embodiments have been described as being implemented on the systems of the embodiments described, the methods and systems of the present invention need not be implemented in conjunction with each other, but can be implemented on alternative systems or using alternative methods respectively.

The invention claimed is:

1. A method of controlling power consumption in a plurality of climate control appliances, each of which is connected to a plurality of neighbouring appliances and has a running cycle of predetermined length, each appliance having an active state in which it is actively controlling a climate parameter and an inactive state in which it is not actively controlling the climate parameter, each appliance being able to communicate with its neighbouring appliances in both the active and inactive states, the method including the steps of:

setting a cap for the power consumption of each group of appliances comprising an appliance and its neighbours;

setting a threshold value for the climate parameter separating values for said parameter into a preferred side of said threshold value and a non-preferred side of said threshold value; and when a first of said climate control appliances reaches the end of its running cycle:

measuring a climate parameter associated with the area around said first climate control appliance;

the first climate control appliance determining whether being in an inactive state for the following running cycle will result in said climate parameter falling on the preferred side of said threshold value;

if so, said first appliance being placed in an inactive state for its next running cycle;

if not, the first appliance:

causing each of its neighbouring appliances which is currently in an active state to determine the climate parameter associated with the area around that appliance at the end of its current running cycle if the appliance was to become inactive for the rest of its cycle in mid-cycle;

determining a subset of the first appliance and the neighbouring appliances currently in an active state which should be in an active state, the subset being those appliances for which the determined climate parameter meets one of: (a) falling on the non-preferred side of said threshold value and furthest from said threshold value based upon a comparison of the determined climate parameter values and (b) if no appliances fall on the non-preferred side of said threshold value, falling closest to said threshold value on the preferred side based upon a comparison of determined climate parameter values, and the number of appliances in said subset being selected so as to ensure that said cap is not exceeded.

2. The method according to claim 1, further including the step of placing all appliances in said group which are not in said determined subset in an inactive state in mid-cycle.

3. The method according to claim 1, wherein the step of causing involves the sub-step of:

the first climate control appliance sending a message to each of its neighbouring appliances, and the step of determining involves the sub-steps of:

each neighbouring appliance which is currently in an active state sending the results of its determination to the first appliance; and the first appliance communicating an instruction to become inactive to any appliance currently in an active state which is not in said subset.

4. The method according to claim 1, further including the steps of:

determining the occupancy of an area served by at least one of said climate control appliances; and setting said cap for the group of appliances comprising said at least one climate control appliance based on said determination of occupancy.

5. The method according to claim 1, further including the step of:

adjusting said cap for one or more of said groups of appliances or removing said cap for one or more of said groups of appliances by incrementally increasing said cap over a predetermined period of time.

6. The method according to claim 1, wherein the cap is dynamically adjusted to match the demand level of said plurality of climate control appliances to a time-varying power supply level.

7. A climate control appliance which is connected to a plurality of neighbouring climate control appliances and has a running cycle of predetermined length, each appliance having an active state in which it is actively controlling a climate parameter and an inactive state in which it is not actively controlling the climate parameter, each appliance being able to communicate with its neighbouring appliances in both the active and inactive states, the climate control appliance having a processor which is arranged to:

when said climate control appliance reaches the end of its running cycle:

measure a climate parameter associated with the area around said climate control appliance;

determine whether being in an inactive state for the following running cycle will result in said climate parameter falling on the preferred side of a predetermined threshold value for said climate parameter which separates values for said parameter into a preferred side of said threshold value and a non-preferred side of said threshold value;

if so, place said appliance in an inactive state for its next running cycle;

if not:

communicate with each of its neighbouring appliances which is currently in an active state to cause those appliances to determine the climate parameter associated with the area around that appliance at the end of its current running cycle if the appliance was to be in an inactive state for the rest of its cycle in mid-cycle; and determine a subset of said appliance and the neighbouring appliances currently in an active state which should be in an active state, the subset being those appliances for which the determined climate parameter meets one of: (a) falling on the non-preferred side of said threshold value and furthest from said threshold value based upon a comparison of determined climate parameter values and (b) if no appliances fall on the non-preferred side of said threshold value, falling closest to said threshold value on the preferred side based upon a comparison of determined climate parameter values, and the number of appliances in said subset being selected so as to ensure that a predetermined cap for the power consumption of the group of appliances comprising said appliance and its neighbours is not exceeded.

8. The climate control appliance according to claim 7, wherein the processor is further arranged to:

send and receive messages to/from each of the neighbouring appliances, said messages including: an instruction for the neighbouring appliance to determine the climate parameter associated with the area around that appliance at the end of its current running cycle if the appliance was to become inactive for the rest of its cycle in mid-cycle; the results of such a determination; and an instruction to a selected appliance which is currently active and which is not in said subset to become inactive in mid-cycle.

9. The climate control appliance according to claim 7, wherein the appliance further includes an occupancy determination sensor which is arranged to determine the occupancy of an area served by said climate control appliance, and wherein the processor is further arranged to set said cap for the group of appliances comprising said climate control appliance based on said determination of occupancy.

10. The climate control appliance according to claim 7, wherein the processor is arranged to receive an instruction from an external controller to adjust said cap to a new level, or to remove said cap, and to respond to said instruction by incrementally increasing said cap over a predetermined period of time.

11. The climate control appliance according to claim 7, wherein the cap is dynamically adjusted to match the demand level of said plurality of climate control appliances to a time-varying power supply level.

12. A building management system comprising a plurality of climate control appliances each of which is connected to a plurality of neighbouring appliances and having a running cycle of predetermined length, each appliance having an active state in which it is actively controlling a climate parameter and an inactive state in which it is not actively controlling the climate parameter, each appliance being able to communicate with its neighbouring appliances in both the active and inactive states, each climate control appliance having a processor which is arranged to:

when said climate control appliance reaches the end of its running cycle:

measure a climate parameter associated with the area around said climate control appliance;

determine whether being in an inactive state for the following running cycle will result in said climate parameter falling on the preferred side of a predetermined threshold value for said climate parameter which separates values for said parameter into a preferred side of said threshold value and a non-preferred side of said threshold value;

if so, place said appliance in an inactive state for its next running cycle;

if not:

communicate with each of its neighbouring appliances which is currently in an active state to cause those appliances to determine the climate parameter associated with the area around that appliance at the end of its current running cycle if the appliance was to become inactive for the rest of its cycle in mid-cycle; and determine a subset of said appliance and the neighbouring appliances current in an active state which should be in an active state, the subset being those appliances for which the determined climate parameter meets one of: (a) falling on the non-preferred side of said threshold value and furthest from said threshold value based upon a comparison of determined climate parameter values and (b) if no appliances fall on the non-preferred side of said threshold value, falling closest to said threshold value on the preferred side based upon a comparison of determined climate parameter values, and the number of appliances in said subset being selected so as to ensure that a predetermined cap for the power consumption of the group of appliances comprising said appliance and its neighbours is not exceeded.

13. The building management system according to claim 12, wherein all appliances in said group which are not in said determined subset are placed in an inactive state in mid-cycle.

14. The building management system according to claim 12, wherein the processor of each device is further arranged to:

send and receive messages to/from each of the neighbouring appliances, said messages including: an instruction for the neighbouring appliance to determine the climate parameter associated with the area around that appliance at the end of its current running cycle if the appliance was to become inactive for the rest of its cycle in mid-cycle; the results of such a determination; and an instruction to a selected appliance which is currently in an active state and which is not in said subset to become inactive in mid-cycle, and wherein:

a first climate control appliance which has reached the end of its running cycle is arranged to send a message to each of its neighbouring appliances;

each neighbouring appliance which is currently in an active state is arranged to send the results of its determination to the first appliance; and the first appliance is arrange to communicate an instruction to become inactive in mid-cycle to any appliance which is currently in an active state and which is not in said subset.

15. The building management system according to claim 12, wherein each appliance further includes an occupancy determination sensor which is arranged to determine the occupancy of an area served by said climate control appliance, and wherein the processor is further arranged to set said cap for the group of appliances comprising said climate control appliance based on said determination of occupancy.

16. The building management system according to claim 12, further including a controller for said climate control appliances, wherein the processor of each appliance is arranged to receive an instruction from an external controller to adjust said cap to a new level, or to remove said cap, and to respond to said instruction by incrementally increasing said cap over a predetermined period of time.

17. The building management system according to claim 12, further including a controller for said climate control appliances, wherein said controller is arranged to dynamically adjust said cap to match the demand level of said plurality of climate control appliances to a time-varying power supply level.

* * * * *